US008233810B2

(12) United States Patent
Genda

(10) Patent No.: US 8,233,810 B2
(45) Date of Patent: Jul. 31, 2012

(54) IMAGE FORMING APPARATUS

(75) Inventor: Daisuke Genda, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 792 days.

(21) Appl. No.: 11/826,308

(22) Filed: Jul. 13, 2007

(65) Prior Publication Data

US 2008/0075479 A1 Mar. 27, 2008

(30) Foreign Application Priority Data

Sep. 21, 2006 (JP) ..... 2006-255127

(51) Int. Cl.
*G03G 15/00* (2006.01)

(52) U.S. Cl. ..... 399/23; 399/16; 399/21; 399/388; 399/389; 399/391

(58) Field of Classification Search ..... 399/23, 399/391, 388, 389; 358/1.15
See application file for complete search history.

(56) References Cited

U.S. PATENT DOCUMENTS 5,752,697 A * 5/1998 Mandel et al. ..... 271/288
5,754,744 A * 5/1998 Matsumoto et al. ..... 358/1.13
2003/0090697 A1* 5/2003 Lester et al. ..... 358/1.14
2005/0275859 A1* 12/2005 Kato ..... 358/1.12
2006/0092450 A1* 5/2006 Kanazawa et al. ..... 358/1.13
2006/0228122 A1* 10/2006 Kamei et al. ..... 399/23

FOREIGN PATENT DOCUMENTS

JP 10-133530 5/1998

* cited by examiner

*Primary Examiner* — Matthew G Marini
*Assistant Examiner* — Allister Primo
(74) *Attorney, Agent, or Firm* — Finnegan, Henderson, Farabow, Garrett & Dunner, L.L.P.

(57) ABSTRACT

An image forming apparatus for forming an image according to a specified printing time, including:

an image forming condition setting unit for setting an image forming condition including an information related to the specified printing time and an information related to recording material;

a control unit adapted to calculate a recording material acquisition startup time for starting to acquire a recording material based on the image forming condition set by the image forming condition setting unit, and adapted to issue a warning related to a replenishment of the recording material, and/or to inhibit formation of image, after the recording material acquisition startup time, in the case where there is no recording material specified under the image forming condition or in the case where the recording material is insufficient.

15 Claims, 15 Drawing Sheets

FIG. 15

| IMAGE FORMING APPARATUS (A1) | RECEIVER INDIVIDUAL INFORMATION (A) | | (A2) |
|---|---|---|---|
| MFP1 | 2345 | 1123 | |
| | 2356 | | |
| | 3456 | | |
| MFP2 | 3456 | 7566 | |
| | 1234 (a1) | 1234 (a2) | |
| | 6735 | | |
| MFP3 | 5666 | | |
| | ⋮ | | |
| | ⋮ | | |
| MFP4 | 3223 | | |
| | 2212 | | |
| | | | |
| MFP5 | | | |
| | | | |
| | | | |
| ⋮ | ⋮ | | |
| | ⋮ | | |
| | ⋮ | | |
| MFPn | 9922 | | |
| | 3456 | | |
| | 6661 | | |

IMAGE FORMING APPARATUS

RELATED APPLICATION

This application is based on Japanese Patent Application No. 2006-244127 filed on Sep. 21, 2006 in Japanese Patent Office, the entire content of which is hereby incorporated by reference.

FIELD OF THE INVENTION

The present invention relates to an image forming apparatus, particularly to an image forming apparatus capable of specifying the time of printing.

BACKGROUND OF THE INVENTION

A proposal has been made of an image forming apparatus that allows the time of printing to be specified, wherein, in order to prevent the sheets on a sheet feed tray from being used for other purposes and becoming insufficient during the course of time from setting of the printing time to the formation of an image, the number of specified sheets stored in the sheet feed tray is compared with the number of sheets with an image to be formed thereon; and if there is a shortage of sheets, a warning is issued to replenish the sheets (e.g., Patent Document 1

[Patent Document 1] Unexamined Japanese Patent Application Publication No. 10-133530

The image forming apparatus described in Patent Document 1, however, outputs the warning to prompt sheet replenishment whenever there is a shortage of specified sheets from setting of the printing time specification job up to the advent of the specified printing time.

Thus, if there is a shortage of sheets, a warning for prompting replenishment is issued, even when there are several months before the specified printing time and there is still time before the specified sheets are to be replenished without immediate need for replenishing the specified sheets. Then the operator having specified the printing time or the other person working close to the image forming apparatus has to replenish the sheets in response to each warning or to release or ignore the premature sheet replenishment request. This method imposes unwanted (premature) work load on the operator.

SUMMARY

One aspect of the present invention is an image forming apparatus for forming an image according to a specified printing time, the image forming apparatus comprising:

an image forming condition setting unit for setting an image forming condition including an information related to the specified printing time and an information related to recording material;

a control unit adapted to calculate a recording material acquisition startup time for starting to acquire a recording material based on the image forming condition set by the image forming condition setting unit, and adapted to issue a warning related to a replenishment of the recording material, and/or to inhibit formation of image, after the recording material acquisition startup time, in the case where there is no recording material specified under the image forming condition or in the case where the recording material is insufficient.

Another aspect of the present invention is an image forming apparatus communicably connecting to an other image forming apparatus, sending to the other image forming apparatus a printing time specification job for forming an image according to a specified print time and making the other image forming apparatus execute the printing time specification job, comprising:

an image forming condition setting unit for setting an image forming condition including an information related to the specified printing time and an information related to a recording material;

a control unit adapted to calculate a recording material acquisition startup time for starting to acquire the recording material based on the image forming condition set by the image forming condition setting unit, adapted to check the recording material specified by the image forming condition to the other imaging forming apparatus after the recording material acquisition startup time, and adapted to inhibit the other image forming apparatus from forming the image, in the case where there is no recording material specified under the image forming condition or in the case where the recording material is insufficient.

Another aspect of the present invention is a printing control method in an image forming system, wherein the system comprises a plurality of image forming apparatuses communicably connected each other and a first image forming apparatus of the plurality of image forming apparatuses sends a printing time specification job to a second image forming apparatus of the plurality of image forming apparatuses to execute the printing time specification job, the control method comprising:

acquisition a printing time specification job information including information related to a print time and an information related to recording material, calculating a recording material acquisition startup time for starting to acquire a recording material based on the printing time specification job information, checking the recording material specified by the printing time specification job information to the second image forming apparatus, and inhibiting executing the printing time specification job after the recording material acquisition startup time in the case where there is no recording material specified under the printing time specification job information or in the case where the recording material is insufficient.

BRIEF DESCRIPTION OF THE DRAWINGS

FIG. 15 is an explanatory diagram representing the receiver individual information/image forming apparatus table.

DESCRIPTION OF THE PREFERRED EMBODIMENTS

The following describes the embodiments of the present invention. It should be noted, however, that the following description does not restrict the technological scope of the invention claimed or meaning of the terminologies. Further, the assertive description of the following embodiments in the present invention refers to preferred examples without restricting the meaning of the terminologies and technological scope of the present invention.

The image forming apparatus has an image forming unit and communications unit. If the printing time specification job information (the specified printing time, the number of sheets with an image to be formed thereon, sheet type, and sheet size) can be set, it can be a FAX, printer, photocopier, MFP (Multi-Function Peripheral) provided with a plurality of these functions, or PC with printer function.

The image forming apparatus includes the type wherein a drum-like photoreceptor is used as an image forming member or that type wherein a belt-like intermediate transfer member is used as an image forming member. The following description refers to an color image forming apparatus wherein the belt-like intermediate transfer member is used as an image forming member.

Figure 1:
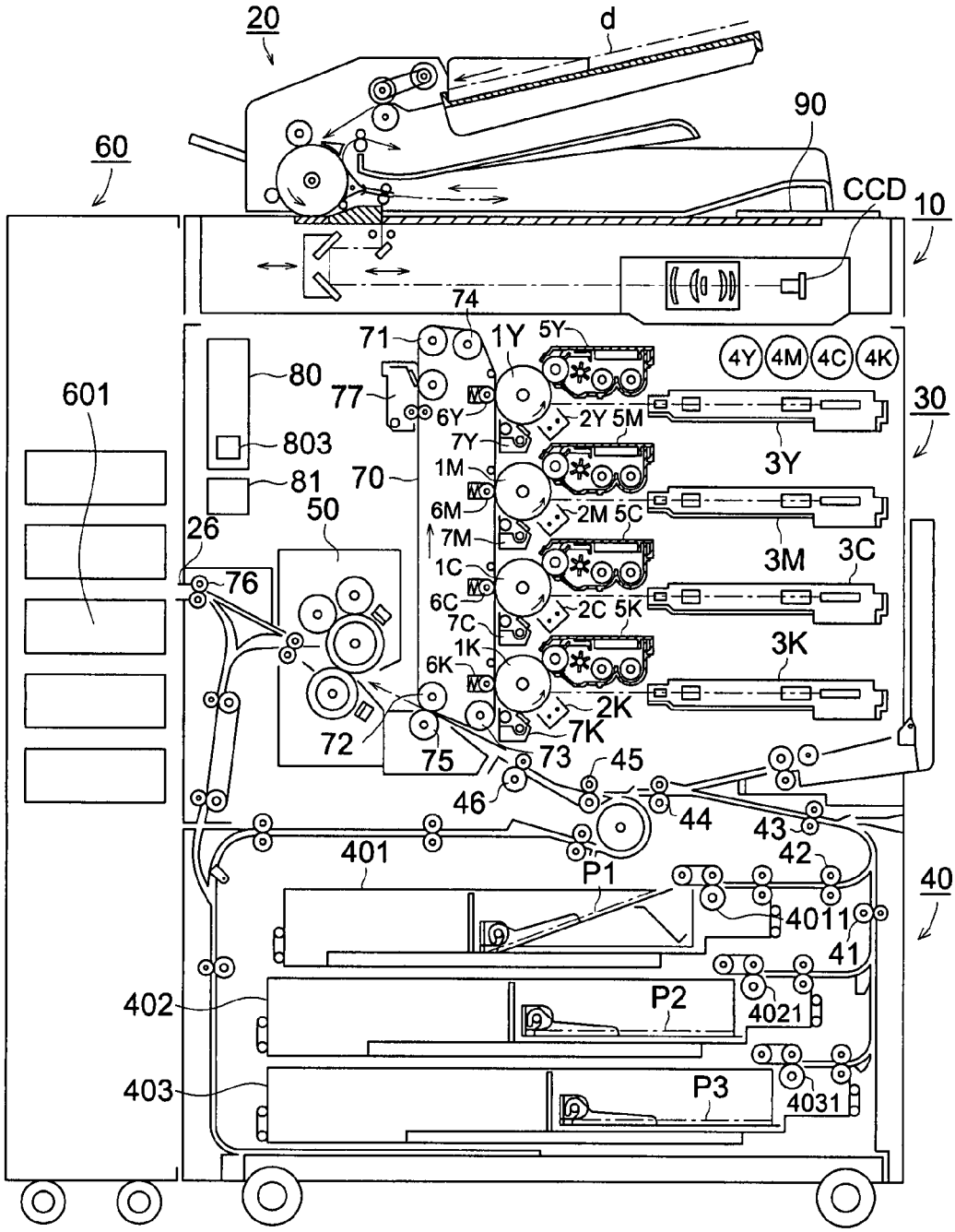
FIG. 1 is a schematic diagram showing a cross sectional view of an example of an image forming apparatus.

FIG. 1 is a schematic diagram showing a cross sectional view of an example of the image forming apparatus.

This image forming apparatus is an image forming apparatus known by the name of tandem full-color photocopier, and includes a document image reading section 10, document conveying section 20, image forming section 30, sheet feed section 40 and fixing unit 50.

A sheet stacking apparatus 60 provided with a plurality of sheet storage cassettes is connected downstream from the fixing unit 50, and is controlled by the image forming apparatus. A plurality of sheet storage cassettes move in the longitudinal direction of FIG. 1. When a predetermined sheet storage cassette has come to the same position as the sheet ejection outlet 26, the sheet having been ejected is stored in a predetermined sheet storage cassette out of a plurality of sheet storage cassettes A document image reading section 10 and a document conveying section 20 are arranged on the top of the image forming section 30 related to image formation. The image of the document d fed by the document conveying section 20 is formed on the line image sensor CCD by the optical system of the document image reading section 10, and is read into the system.

The analog signal having been subjected to photoelectric conversion by the line image sensor CCD is subjected to analog processing, analog-to-digital conversion, shading correction, image compression, and other processing in an image processing section (not illustrated), and is turned into digital image data for each of Y (yellow), M (magenta), C (cyan) and K (black).

The drum-like photoreceptors 1Y, 1M, 1C and 1K as the first image carriers corresponding to colors of Y, M, C and K, respectively, are uniformly charged by the charging apparatuses 2Y, 2M, 2C and 2K corresponding to these colors.

The exposure apparatuses 3Y, 3M, 3C and 3K corresponding to respective colors allow latent images to be formed on the photoreceptors 1Y, 1M, 1C and 1K, based on the digital image data of each color.

Toner of each color is supplied to the development apparatuses 5Y, 5M, 5C and 5K from the toner replenishment apparatuses 4Y, 4M, 4C and 4K of these colors for supplying toner, and the latent images corresponding to respective colors formed on the photoreceptors 1Y, 1M, 1C and 1K are developed by toner.

The development apparatuses 5Y, 5M, 5C and 5K are arranged in a file in the vertical direction. An intermediate transfer member 70 as a second image carrier of semiconducting endless belt type applied so as to wind and rotate the rollers 71, 72, 73 and 74 is mounted on the left side of the photoreceptors 1Y, 1M, 1C and 1K in FIG. 1.

The intermediate transfer member 70 is driven in the arrow-marked direction by the drive apparatus (not illustrated) connected to the roller 71.

The primary transfer rollers 6Y, 6M, 6C and 6K corresponding to respective colors as the primary transfer units are operated on an selective basis by the control unit 80 in response to the type of image, and the intermediate transfer members 70 are pressed against the corresponding photoreceptors 1Y, 1M, 1C and 1K.

As described above, the toner images of respective colors formed on the photoreceptors 1Y, 1M, 1C and 1K by the development apparatuses 5Y, 5M, 5C and 5K are sequentially transferred on the intermediate transfer members 70 rotated by the primary transfer rollers 6Y, 6M, 6C and 6K, and a composite color toner image is formed.

After the toner image has been transferred to the intermediate transfer member 70 by the primary transfer rollers 6Y, 6M, 6C and 6K, the photoreceptors 1Y, 1M, 1C and 1K, residual toner is removed by the cleaning units 7Y, 7M, 7C and 7K.

The image forming section 30 refers to the section for image formation, including photoreceptors 1Y, 1M, 1C and 1K, charging apparatuses 2Y, 2M, 2C and 2K, exposure apparatuses 3Y, 3M, 3C and 3K, toner replenishment apparatuses 4Y, 4M, 4C and 4K, development apparatuses 5Y, 5M, 5C and 5K, primary transfer rollers 6Y, 6M, 6C and 6K, cleaning units 7Y, 7M, 7C and 7K, intermediate transfer member 70, rollers 71, 72, 73 and 74, secondary transfer roller 75, and cleaning unit 77.

The first sheet P1 as a recording medium stored in the first sheet feed cassette 401 is fed by the sheet feed roller 4011, and is conveyed to the secondary transfer roller section as a secondary transfer unit through a plurality of intermediate rollers 42, 43, 44 and 45 and registration roller 46. The composite toner image formed on the intermediate transfer member by the secondary transfer roller 75 is collectively transferred onto the sheet P1.

Similarly, the second sheet P2 stored in the second sheet feed cassette 402, and third sheet P3 stored in the third sheet feed cassette 403 each are conveyed to the secondary transfer roller 75, as required, and the composite images formed on the intermediate transfer member are collectively transferred onto the sheet P2 or P3 by the secondary transfer roller 75.

In this case, the secondary transfer roller 75 presses the intermediate transfer member 70 and sheet to the roller 72 only when the sheet passed by this position and the secondary transfer is implemented.

The sheet with the color toner image transferred thereon is subjected to a process of fixing by a fixing unit 50. Being sandwiched between the sheet ejection roller 76, the sheets are ejected from the ejection outlet 26 to the sheet stacking section 60, and are stacked into a predetermined sheet ejection tray in the sheet stacking section 60.

Control is provided by the control unit of the sheet stacking section 60 to ensure that a predetermined sheet ejection tray (e.g., sheet storage cassette 601 designed specifically for printing time specification job) specified by the control unit 80 will be aligned with the ejection outlet 26.

In the meantime, after the color image has been transferred to the sheet by the secondary transfer roller 75, the residual toner is removed by the cleaning unit 77 from the intermediate transfer member 70 with the sheet having been subjected to curvature separation.

The operation panel 90 has a touch panel to display various forms of information as well as various forms of keys, and the key selection information is inputted into the control unit 80.

When the document image reading instruction has been inputted into the operation panel 90 together with the information related to the printing time specification job as a job for specifying the printing startup time (the specified printing time, sheet type, sheet size, the number of sheets with an image to be formed thereon), the control unit 80 causes the document image reading section 10 to read the document image, and to acquire the digital image data. Further, the digital image data having been acquired and the information on the printing time specification job having been inputted are combined and are stored in the RAM (Random Access Memory) 803.

In the following description, the information on printing time specification job will be referred to as printing time specification job information.

When the control unit 80 has reached the specified printing time, sheets are fed from the sheet feed cassette (e.g., the first sheet feed cassette 401) storing the sheets having the sheet type and sheet size specified by the printing time specification job, and an image is formed by the image forming section 30 based on the acquired digital image data.

The communications unit 81 is controlled by the control unit 80, and exchanges digital image data of printing time specification job information and printing time specification job with the external PC (personal computer), image forming apparatus, server and others connected through the Internet or LAN (Local Area Network).

Figure 2:
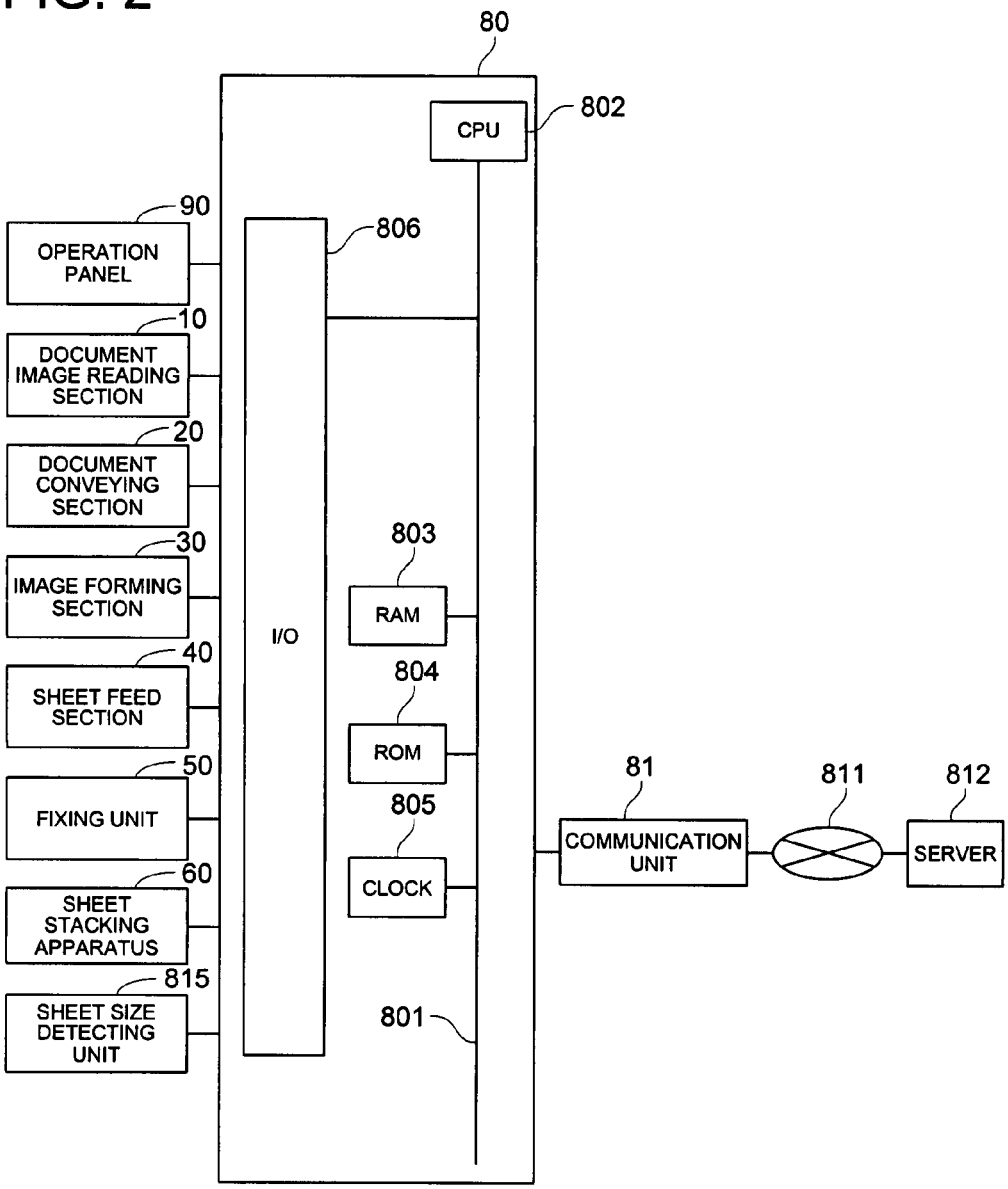
FIG. 2 is a block diagram representing an image forming apparatus.

FIG. 2 is a block diagram representing an image forming apparatus.

The following describes the MFP as an example of the image forming apparatus. In the following description, the image forming apparatus will also be called the MFP.

The MFP incorporates a control unit 80, an operation panel 90 connected with the control unit 80, a document image reading section 10, a document conveying section 20, an image forming section 30, a sheet feed section 40, a fixing unit 50, a sheet stacking section 60 and a communications unit 81.

The control unit 80 includes a CPU (Central Processing Unit), a RAM 803, a ROM 804, a clock 805, an I/O controller 806 for controlling the document image reading section 10, document conveying section 20, image forming section 30, sheet feed section 40, fixing unit 50, sheet stacking section 60, operation panel 90 and communications unit 81 under the control of the CPU 802, and a bus 801 for connecting them.

The ROM 804 stores in advance the program for controlling the entire MFP and this program is read by the RAM 803 by the CPU 802, whereby the following control is implemented.

Under the control of the control unit 80, the operation panel 90 displays the printing time specification job information input screen or the like for inputting the printing time specification job information through the I/O controller 806. It detects the information (ON/OFF) for operating various forms of keys in the printing time specification job information input screen, and inputs it into the control unit 80.

The printing time specification job information includes information on the specified printing time, sheet type, sheet size and the number of sheets with an image to be formed thereon.

When the document image reading instruction information is inputted from the operation panel 90 through the I/O controller 806, the document image reading section 10 reads the document image and the inputs document image information into the control unit 80 under the control of the control unit 80.

The control unit 80 processes the document image information read by the document image reading section 10, and the resultant information is used as digital image information. This digital image information and the printing time specification job information specified by the printing time specification job information input screen are associated with each other, and are stored in the RAM 803.

The communications unit 81 is linked with an external PC (personal computer), MFP and server 812 through the Internet 811, and exchanges with them the information on the printing time specification job information and digital image data on the printing time specification job under the control of the control unit 80 through the I/O controller 806. The control unit 80 associates the printing time specification job information received from the communications unit 81 with the digital image data on printing time specification job, and stores them into the RAM 803.

Based on the printing time information and sheet acquisition enabled time, the control unit 80 calculates the sheet acquisition start-up time for starting imposition of restrictions on the use of sheets.

The sheet acquisition enabled time refers to the time when the MFP can replenish recording sheets. It corresponds to the usage interval time normally used in the MFP.

Under the control of the control unit 80, the sheet size detecting unit 815 detects the size of the sheets stored in each sheet feed cassette and inputs the sheet size information into the control unit 80 through the I/O controller 806.

The control unit 80 causes the RAM 803 to store the sheet type information that is inputted from the operation panel 90 and is stored in each sheet feed cassette.

The control unit 80 causes the RAM 803 to store the number of sheets that is inputted from the operation panel 90 and is stored in each sheet feed cassette. The remaining sheets are counted according to the usage of these sheets, and the resulting count is stored in the RAM 803.

The control unit 80 constantly monitors the sheet feed section 40, and compares the sheet specified by the printing time specification job (sheet size, sheet type, the number of sheets with an image to be formed thereon), the sheet size detected by the sheet size detecting unit 815, the sheet type stored in the RAM 803, and the number of remaining sheets.

If there is no sheet of the sheet information specified by the printing time specification job, or such sheets are insufficient (i.e., there is no sheet feed tray of matching sheet size and sheet type, or the number of remaining sheets stored in that tray is smaller than the number of sheets with an image to be formed thereon specified by the printing time specification job information, although there is a sheet feed tray of matching sheet size and sheet type), then all image forming operations are inhibited during the time period from the sheet acquisition start-up time to the arrival of the printing time in order to prompt the supply of sheets to meet the requirements of the sheet information, on the operation panel 90, and a warning is displayed to prompt replenishment of sheets as specified by the printing time specification job.

The warning is given by visual indication on the touch panel and/or by aural sound such as a buzzer sound.

If there are sheets of the sheet information specified by the printing time specification job, the control unit 80 selects the sheet feed cassette storing such sheets based on the information on the sheet type, sheet size and the number of sheets with an image to be formed thereon information out of the printing time specification job information.

When the printing time has been reached, the control unit 80 causes the sheets to be fed from the sheet feed cassette having been selected, and allows the image forming section 30 to form an image according to digital image data of the printing time specification job, synchronously with sheet feed.

Figure 3:
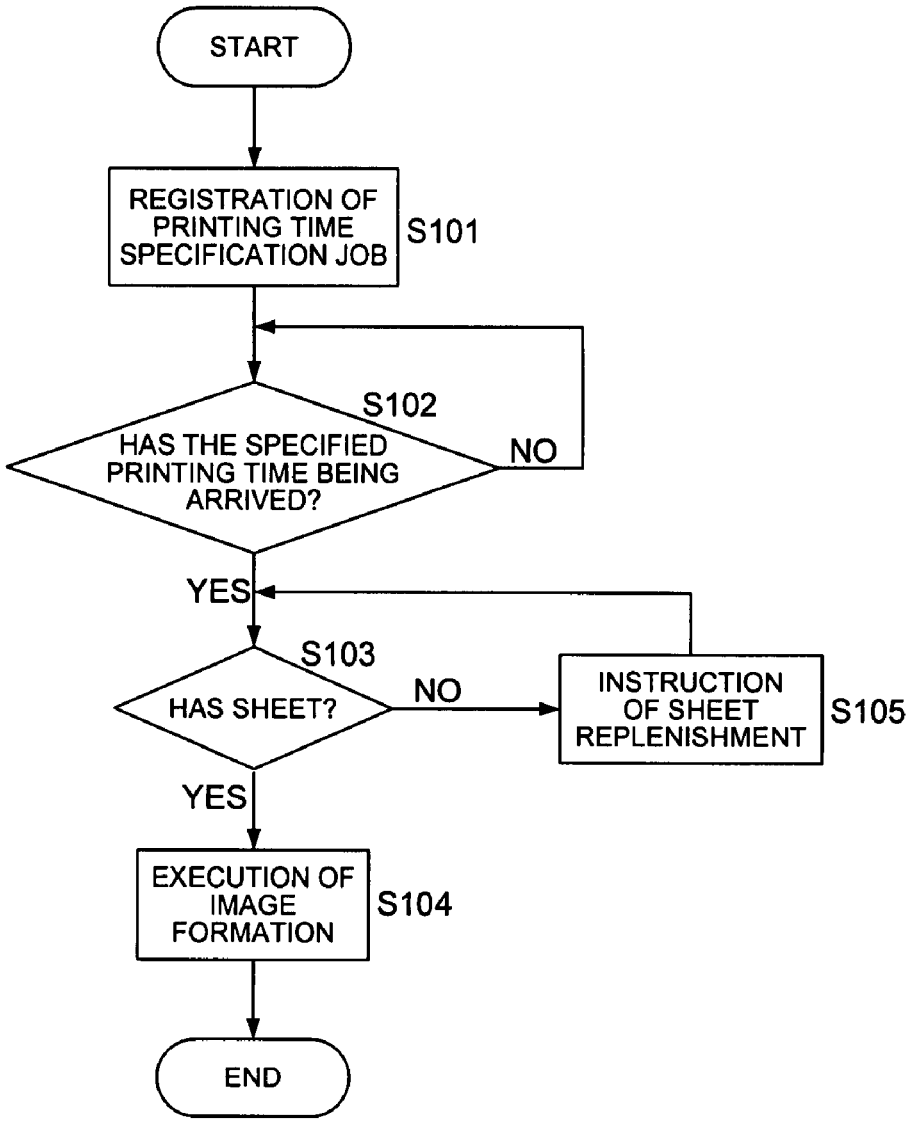
FIG. 3 is a conceptual flow chart representing the basic process of the printing time specification job.

FIG. 3 is a conceptual flow chart representing the basic process of the printing time specification job.

Figure 4:
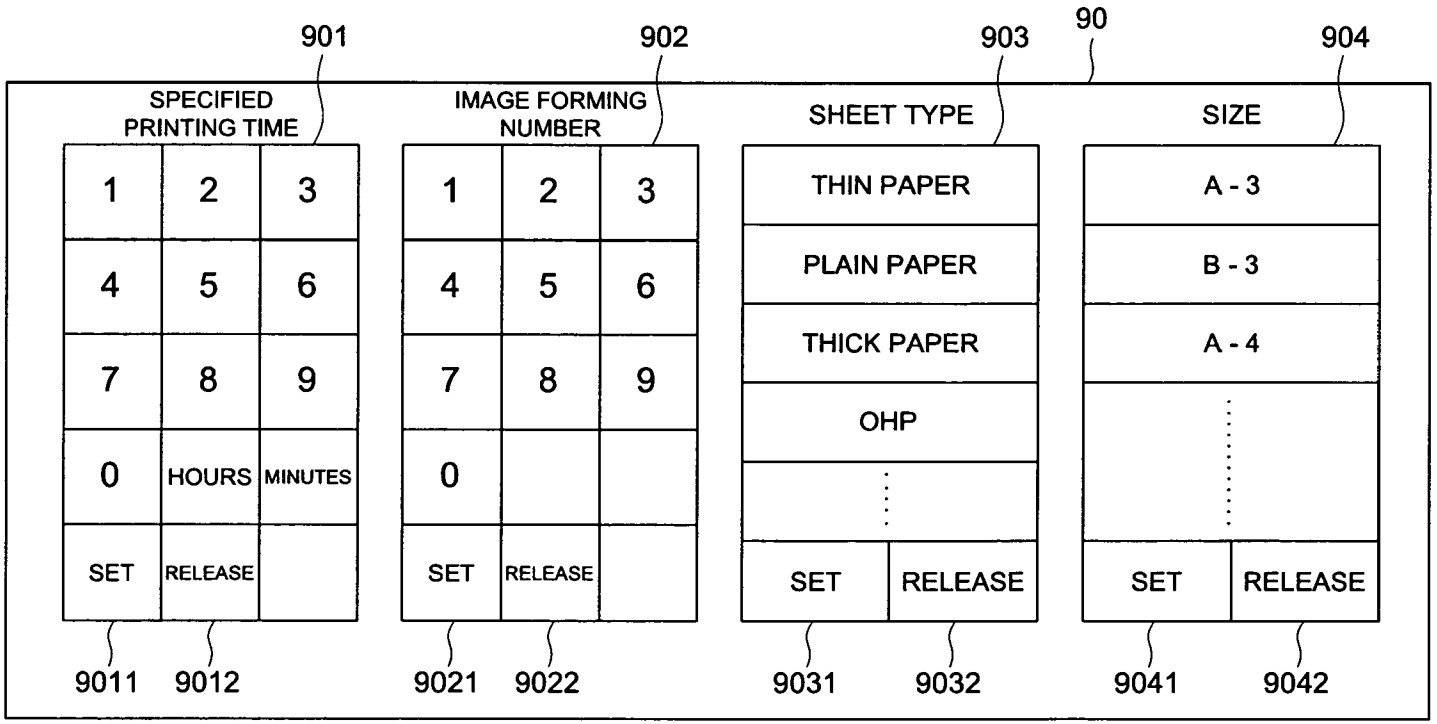
FIG. 4 is a conceptual diagram representing the printing time specification job condition setting screen of the operation panel.

FIG. 4 is a conceptual diagram representing the printing time specification job condition setting screen of the operation panel.

1. Registration of printing time specification job: The control unit 80 causes the basic screen to be displayed on the MFP operation panel 90. When the application mode has been selected on the basic screen by the operator, the system goes to the application mode, and the application screen appears. When the printing time specification job mode has been selected on the application screen by the operator, the system goes to the printing time specification job mode, thereby displaying the printing time specification job condition setting screen for inputting the printing time specification job information shown in FIG. 4.

The printing time specification job condition setting screen 90 displays the specified printing time setting section 901 for inputting the specified printing time, the number of sheets with an image to be formed thereon setting section 902 for inputting the number of sheets with an image to be formed thereon, the sheet type setting section 903 for inputting the type of sheet, and the sheet size setting section 904 for inputting the sheet size.

The operator sets the specified printing time at the specified printing time setting section 901, the number of sheets with an image to be formed thereon at the setting section 902, the sheet type at the sheet type setting section 903, and the sheet size at the sheet size setting section 904. When the operator presses the start key later, the control unit 80 executes reading of document image, associates the image data having read and the print time specification job information having set each other, stores them in the RAM 803 and register them as a job (Step S101). The number of sheet for image forming may be calculated and set according to the number of copies inputted through the operation panel and the number of the documents having read though the present embodiment shows that the number of image forming is inputted through operation panel.

Such information is set by the setting keys 9011, 9021, 9031 and 9041, and is released for correction by the release keys 9012, 9022, 9032 and 9042.

2. Monitoring the arrival of the specified printing time: The control unit 80 monitors the current time on the clock 805, and compares in with the specified printing time stored in the RAM 803. The system waits until the current time matches the specified printing time (No in Step S102). When matching has been found out (Yes), a decision step is taken to determine that the printing time has come, and goes to the Step S103.

3. Sheet presence/absence verification: Under the control of the control unit 80, the number of remaining sheets obtained by subtracting the number of sheets to be used, from the number of sheets inputted from the operation panel 90 at the time of sheet replenishment and stored in the RAM 803 is stored in the RAM 803 as the information on the number of stored sheets. Then the information on the number of stored sheets and the sheet type information for each sheet feed cassette stored in the RAM 803, and the sheet size information detected by the size detecting unit 815 are read. The number of sheets with an image to be formed thereon information, sheet type information and sheet size information stored in the RAM 803 as printing time specification job information in Step S101 are read out, and they are compared with each other.

When there is a sheet feed tray wherein a match is found in the sheet size and sheet type, and the number of remaining sheets stored in that tray is equal to or greater than the number of sheets with an image to be formed thereon specified on the printing time specification job information (Yes), then a decision step is taken to determine that there are sheets that are used for the printing time specification job, and the system goes to Step S104 (Step S103).

4. Execution of image formation: Sheets are fed from the sheet feed tray for storing the matched sheets and an image is formed according to the image information stored in the Step S101 (Step S104).

5. Sheet replenishment instruction: In Step S103, if there is no sheet specified by the printing time specification job (or if the number of such sheets is insufficient) (No), the control unit 80 ensures that a warning to prompt replenishment of sheets is displayed on the operation panel 90 (Step S105).

Figure 5:
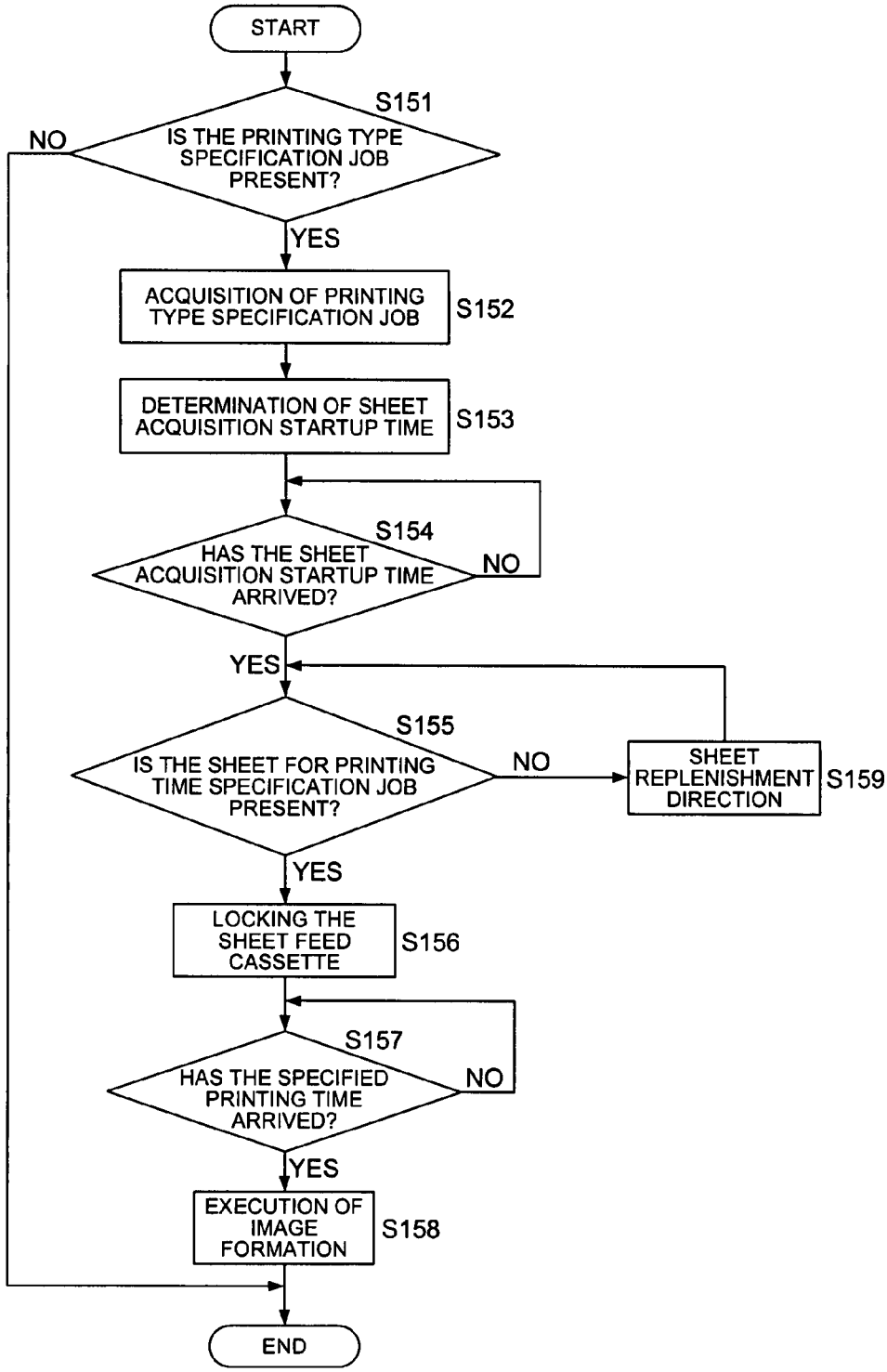
FIG. 5 is a flow chart for acquiring the sheets of the printing time specification job.

FIG. 5 is a flow chart for acquiring the sheets of the printing time specification job.

1. The presence/absence verification: The control unit 80 of the printing time specification job checks if the printing time specification job is recorded in the RAM 803 in Step S101. If it is not stored (No), the system jumps to the End in order to continue the normal mode. If it is stored (Yes), the system goes to Step S152 (Step S151) to enter the printing time specification job mode.

2. Acquisition of printing time specification job information: The control unit 80 reads the specified printing time, the number of sheets with an image to be formed thereon, sheet type and sheet size stored in the RAM 803 in the Step S101 (Step S152).

3. Determining the sheet acquisition start-up time: The control unit 80 reads the sheet acquisition enabled time stored in the ROM 804, subtracts the sheet acquisition enabled time from the specified printing time, determines the sheet acquisition startup time, and stores the result in the RAM 803 (Step S153).

In this case, the sheet acquisition startup time is defined as the time when the sheets can be replenished at the specified printing time almost without fail, even if required sheets are not prepared. To be more specific, it refers to the time point going back the sheet acquisition enabled time from the specified printing time (or the time point obtained by subtracting the sheet acquisition enabled time therefrom). After the sheet acquisition startup time, restriction is imposed on the usage of sheets. The sheet acquisition enabled time when the recording sheet can be replenished to the MFP, as described above. It corresponds to the usage interval time normally used with reference to MFP.

According to the printing time information and sheet acquisition enabled time, the control unit 80 calculates the sheet acquisition startup time when restriction is imposed on the use of sheets.

4. Waiting for sheet acquisition startup time: The control unit 80 monitors the clock 805. If the time matches the sheet acquisition startup time (Yes), the system goes to the Step S155 to acquire sheets. If there is no matching (No), the system is placed in the wait state (No in Step S154).

A request to change the type of sheets in the sheet feed cassette is accepted until the time matches the sheet acquisition startup time.

5. Specified sheet presence/absence verification for printing time specification job: The control unit 80 ensures that the number of remaining sheets obtained by subtracting the number of sheets to be used, from the number of sheets stored in the RAM 803 having been inputted from the operation panel 90 at the time of sheet replenishment is stored in the RAM 803 as information on the number of stored sheets. Then the control unit 80 reads out the information on the number of stored sheets of each sheet feed cassette stored in the RAM 803, the sheet type information, and the sheet size information detected by the size detecting unit 815. It also reads out the number of sheets with an image to be formed thereon information, the sheet type information and sheet size information stored in the RAM 803 as printing time specification job information in Step S101. Then they are compared with each other.

If there is a sheet feed tray wherein matching is found in the sheet size and sheet type, and the number of remaining sheets stored in that tray is equal to or greater than the number of sheets with an image to be formed thereon specified by the printing time specification job information (Yes), a decision step is taken to determine that there are sheets to be used for the printing time specification job, and the system goes to the Step S156. If there is no such tray (No), a decision step is taken to determine that there is no such a sheet, and the system jumps to the Step S159 (Step S155).

6. Locking the sheet acquisition/sheet feed cassette: To disable the use of the sheets from the sheet feed cassette for storing the sheets specified by the printing time specification job (e.g., the first sheet feed cassette 401), the control unit 80 locks this sheet feed cassette and goes to Step S157 (Step S156). It should be noted that locking is performed by the step of the control unit 80 turning on a sheet feed cassette locking member (not illustrated) and locking the open/close operation of the sheet feed cassette.

7. Waiting for the specified printing time: The control unit 80 monitors the clock 805. If the time point matches the specified printing time (Yes), the system goes to Step S158 to form an image according to the printing time specification job, and the system waits until matching occurs (No in Step S157).

The following arrangement can also be used: After the sheet acquisition startup time, the control unit 80 calculates the image formation time required to form an image according to the printing time specification job, before the arrival of the specified printing time, according to the number of sheets with an image to be formed thereon, the sheet type and sheet size read in the Step S152. Printing is started the image formation time before the specified printing time. This arrangement ensures printing to be terminated before the specified printing time, even when a great number of sheets to be printed, thereby eliminating the possibility of being late for the specified printing time.

8. Execution of image formation: When the time matches the specified printing time, the control unit 80 feeds the sheet from the sheet feed tray (e.g., the first sheet feed cassette 401) for storing the matched sheets, and forms an image according to the image information on the printing time specification job stored in the Step S101.

The control unit 80 provides control in such a way that the sheets having been processed by the fixing unit 50 is stored in the sheet storage cassette 601 designed specifically for the printing time specification job of the sheet stacking section 60.

The following arrangement can also be used: The sheet storage cassette 601 designed specifically for the printing time specification job is provided with an open/close lock member (not illustrated) capable of locking the cassette cover described in Step S156. The open/close lock member can be unlocked only by the individual having registered the printing time specification job. This arrangement can be achieved by storing the information of the individual who has registered a job by the individual authentication unit such as a means of biometric authentication at the time of registering the printing time specification job. This information is stored in the form associated with the printing time specification job (Step S158).

9. Sheet replenishment warning: When a decision step is taken to determine in Step S155 that there is no sheet (or sheets are insufficient), then the system jumps to Step S159. In order to promote replenishment of sheets specified by the printing time specification job, the system stops the image forming section 30 and inhibits the formation of an image thereafter. At the same time, a warning is displayed on the operation panel 90 to prompt the replenishment of the sheets specified by the printing time specification job (Step S159).

Further, if the sheets are not replenished just before the specified printing time (e.g., about 10 through 30 minutes), an e-mail can be sent to the individual having registered the printing time specification job in order to prompt the sheet replenishment. This can be achieved by inputting the mail address at the time of registering the printing time specification job, storing it in the form associated with the printing time specification job, and transmitting it through the communications unit 81.

As described above, if there is no sheet specified in the printing time specification job, a warning is given to prompt sheet replenishment before the arrival of the specified printing time, namely, during the time period from the sheet acquisition startup time to the specified printing time. This arrangement permits sheet replenishment without fail. Further, formation of an image is inhibited. This ensures that a person wishing to form an image takes notice of the sheet replenishment warning and replenishes sheets.

As a result, the sheets specified by the printing time specification job can be prepared before the specified printing time, and printing can be started punctually at the specified printing time.

Further, warning of the insufficiency of sheets is not issued before the sheet acquisition startup time. This arrangement eliminates the possibility of giving unwanted work loads on the operator or the person working close to the image forming apparatus.

The storage section of the sheets for normal job can be separated from that of the sheets for the printing time specification job. This eliminates the need of a sorting job resulting from mixing of these sheets, and improves the maneuverability.

Figure 6:
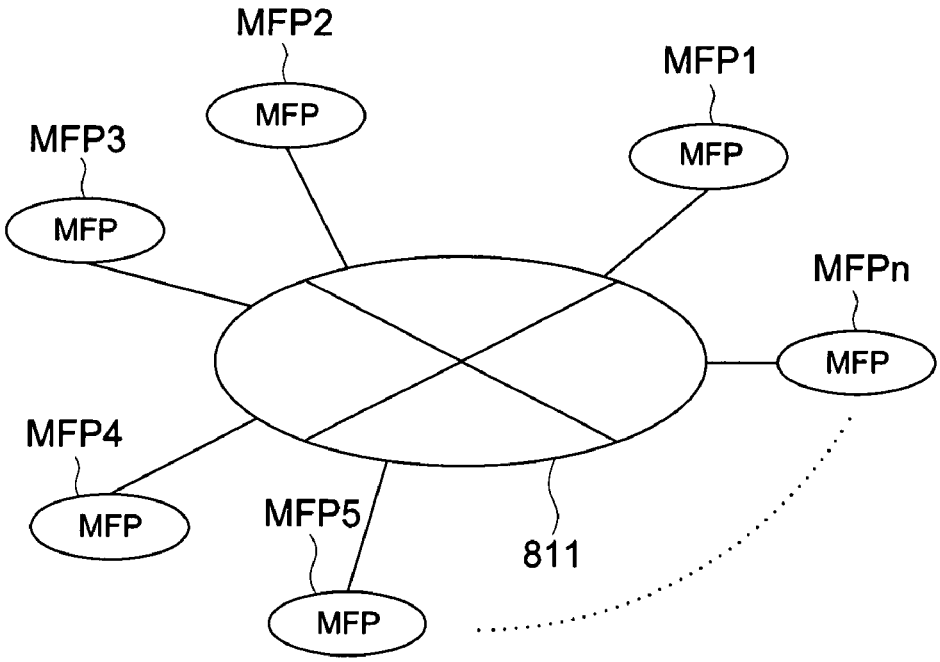
FIG. 6 is a first conceptual diagram showing the exchange of information on a printing time specification job.

The following describes the case of implementing the printing time specification job by the MFP through the Internet, LAN or communication network:

A FAX, printer, MFP, PC having a printer function or a combination of these can be used if the MFP has a communications unit and an image forming unit, and the printing time specification job information (the specified printing time, the number of sheets with an image to be formed thereon, sheet type, and sheet size) can be set. The following describes the cases wherein a plurality of MFPs are connected:

FIG. 6 is a first conceptual diagram showing the exchange of information on a printing time specification job.

A plurality of MFPs (MFP1 through MFPn) are connected via the Internet 811, LAN or communication network so that they can communicate with one another.

Each MFP is provided with code numbers (mfp1 through mfpn). When information is to be exchanged, desired information can be sent to a desired MFP by specifying the code number of that MFP.

Figure 7:
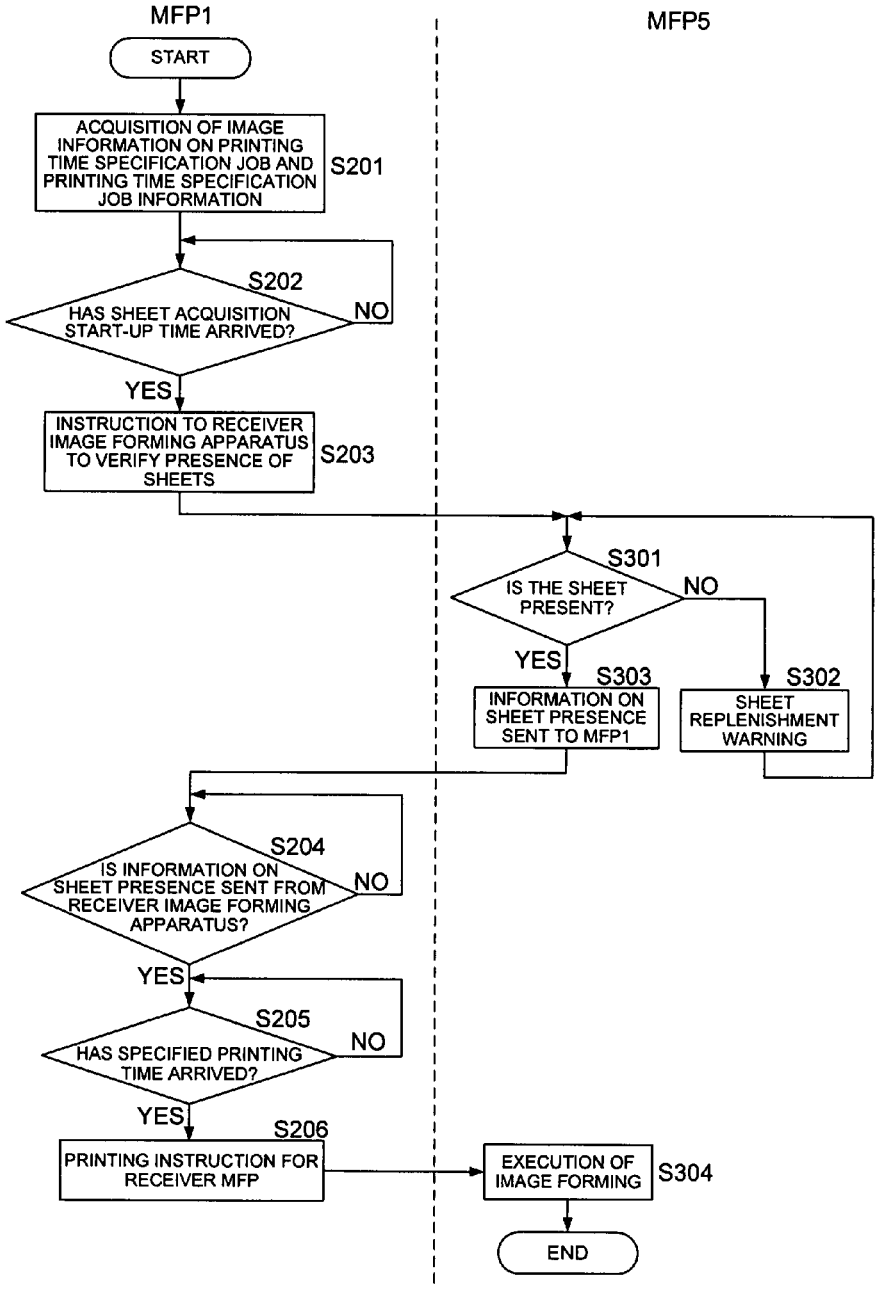
FIG. 7 is a first flow chart showing the exchange of information on the printing time specification job.

FIG. 7 is a first flow chart showing the exchange of information on the printing time specification job.

Referring to FIGS. 2, 6 and 7, the following describes the method wherein the transmitter MFP (e.g., MFP1) for storing the image information on the printing time specification job and printing time specification job information (the specified printing time, the number of sheets with an image to be formed thereon, sheet type, sheet size) specifies the receiver MFP (e.g., MFP5), and sends the image information on printing time specification job, whereby an image is formed at the specified time.

The left half of FIG. 7 is a flow diagram showing the flow of the transmitter MFP, while the right half of FIG. 7 is a flow diagram showing the flow of the receiver MFP.

1. Acquisition of image information on printing time specification job and printing time specification job information: The MFP1 ensures that the image information received from document reading unit or another MFP, the receiver information set by the MFP1 operation panel or received from another MFP, and the printing time specification job information are associated with one another, and are once stored (Step S201).

2. Waiting for sheet acquisition startup time: The MFP1 monitors the clock 805. If the time matches the sheet acquisition startup time (Yes), the MFP1 proceeds to Step S203 to acquire sheets, and waits until matching is found out (No in Step S202).

In this case, sheet acquisition startup time is determined in the manner described with reference to Step S153.

3. Instruction to receiver MFP to verify presence of absence of sheets: The MFP1 conforming to the sheet acquisition startup time specifies the code number of the MFP5 which is a receiver MFP, and sends the image information on the printing time specification job, printing time specification job information, the code number of the MFP1 which is transmitter information, and sheet presence/absence verification instruction information (Step S203).

4. Sheet presence/absence verification: The MFP5 receives the image information on the printing time specification job, printing time specification job information, MFP1 code number and sheet presence/absence verification instruction information. It checks if the sheets conforming in the sheet type and sheet size area accommodated in the sheet feed cassette or not. It further checks if the number of the remaining sheets accommodated therein is equal to or greater than the number of sheets with an image to be formed thereon or not (Step S301).

5. Warning for sheet replenishment: If the aforementioned sheets are not accommodated in the check of Step S301 or the number of them is insufficient (No), the MFP5 specifies the code number of the MFP1 as the party having requested the execution of the printing time specification job, and notifies that there is no sheet. Further, a warning is displayed on the MFP5 operation panel to prompt replenishment of the sheets having the sheet type and size conforming to the printing time specification job (Step S302).

6. Transmission of information on sheet presence to MFP1: If the number of stored sheets is equal to or greater than the number of sheets with an image to be formed thereon (Yes), the MFP5 specifies the code number of the MFP1 and sends the information to notify that sheets are present (Step S303).

7. Monitoring to see if there is transmission of information on sheet presence from receiver MFP: The MFP1 monitors the information on the presence of sheets from the MFP5, and waits for the arrival thereof (Step S204).

8. Waiting for specified printing time: The MFP1 monitors the clock 805 and waits until the time matches the specified printing time (No) (Step S205).

9. Printing instruction for receiver MFP: If matching has been found out (Yes), the MFP1 supplies the MFP5 with the image forming instruction of a printing time specification job (Step S206).

10. Image formation: Upon receipt of the image formation instruction information from the MFP1, The MFP5 forms an image based on the image information of the printing time specification job having been set in Step S203, and printing time specification job information (Step S304).

It is possible to install an MFP for the recipient to send this printing time specification job to the server through the MFP linked to the Internet or the like, so that this printing time specification job is executed by the MFP specified by the recipient.

In this case, the receiver information set on the operation panel or the like (by recipient) of the MFP1 in Step S201 or (from recipient) or the receiver code number having been received through the Internet or the like (specified by the recipient) and the printing time specification job information can be associated with each other and can be stored temporarily.

Figure 8:
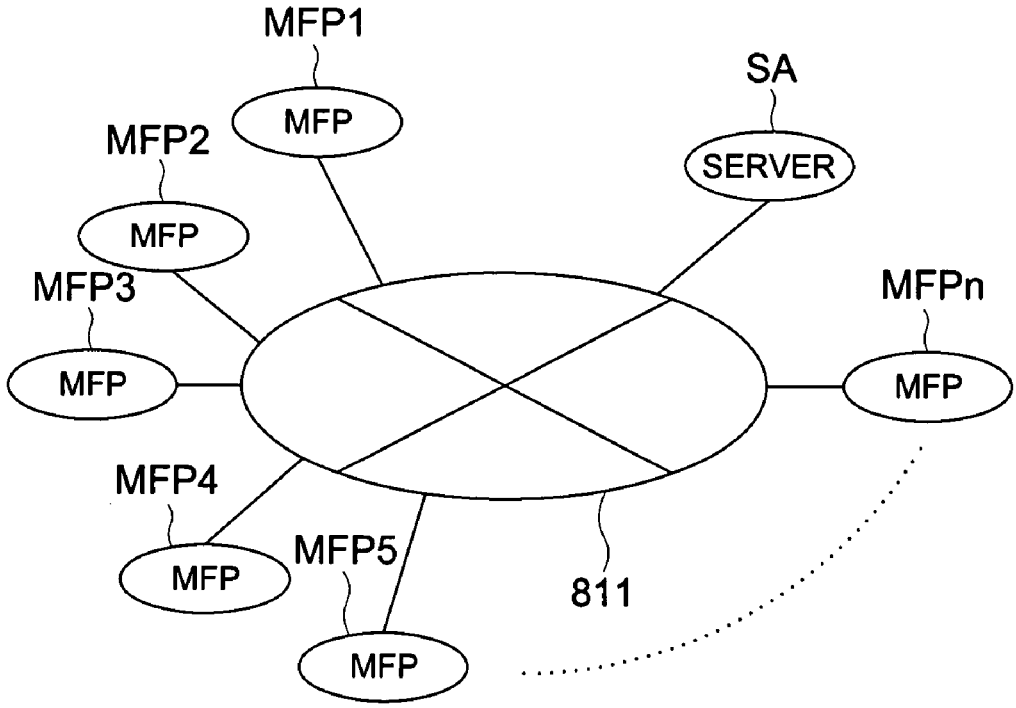
FIG. 8 is a second conceptual diagram showing the exchange of information on the printing time specification job.

The aforementioned procedure ensures that a desired MFP allows any other MFP or the MFP specified by the recipient to execute the printing time specification job with the sheets replenished correctly before the specified time. FIG. 8 is a second conceptual diagram showing the exchange of information on the printing time specification job.

A plurality of MFPs and server SA for administrating a plurality of MFPs (MFP1 through MFPn) are connected through the Internet 811 or LAN or communication network.

Thus, a desired MFP (transmitter) can allow another desired MFP (receiver) to execute the printing time specification job through the server SA.

Each MFP is assigned with a code number.

For example, when a desired MFP (transmitter) allows another desired MFP (receiver) to execute the printing time specification job through the server SA, the MFP of the transmitter specifies the code number of the receiver, and sends the printing time specification job information and the image information of printing time specification job to the server SA. Then the server SA sends the printing time specification job information and the image information of the printing time specification job to the receiver MFP according to the printing time specification job information and the code number of the receiver. The receiver MFP forms an image in response to the printing time specification job information.

Without installing a server, the specific MFP can be provided with a server function to replace the server. In this case, information is exchanged with the MFP having the server function.

Figure 9:
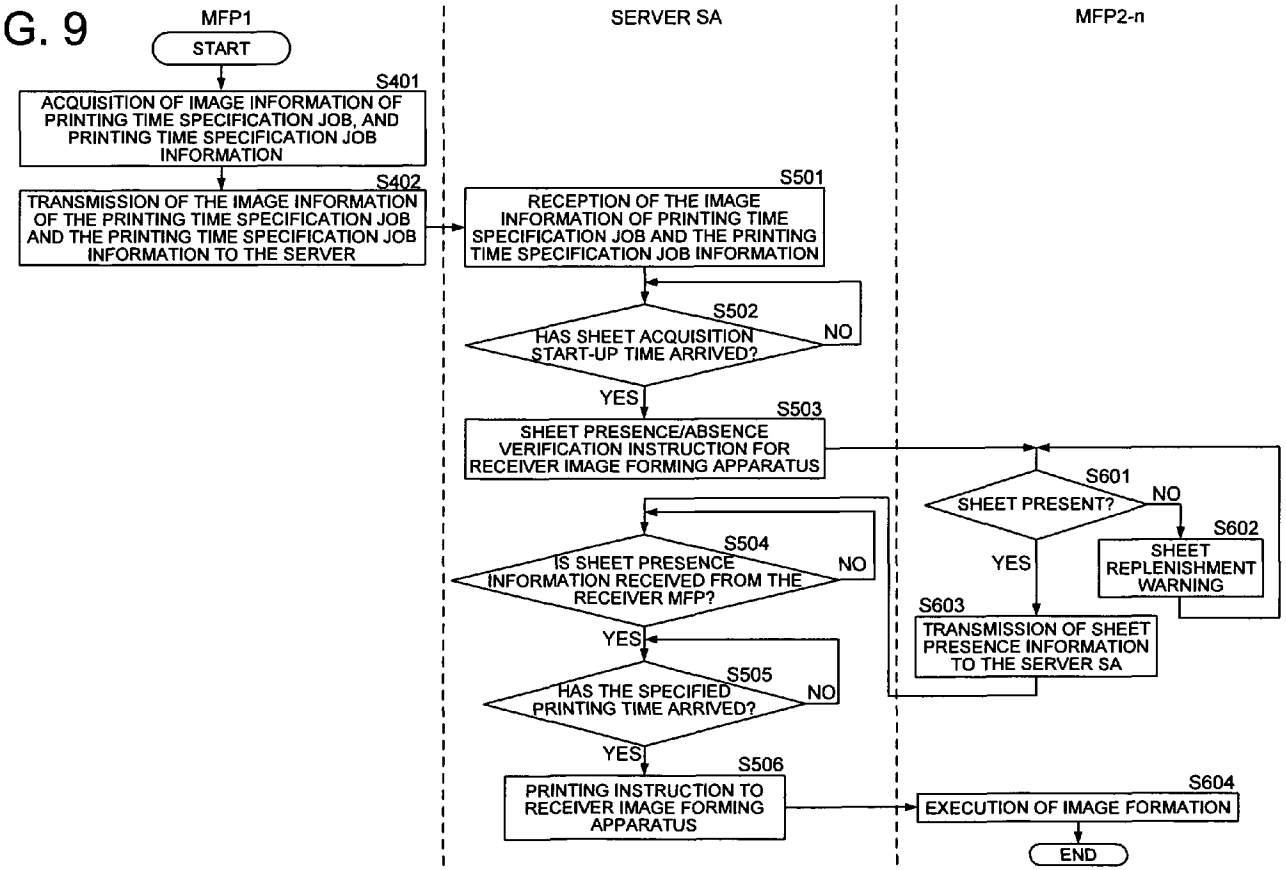
FIG. 9 is a second flow chart showing the exchange of information on the printing time specification job.

FIG. 9 is a second flow chart showing the exchange of information on the printing time specification job.

Referring to FIGS. 2, 8 and 9, the following describes the case wherein a desired MFP (e.g., transmitter MFP1) specifies the receiver MFP, whereby an image of the printing time specification job is formed by the receiver MFP (e.g., MFP1) through the server SA.

The left half of FIG. 9 is a flow of the MFP1, and the right is a flow of the MFP5, with the center showing a flow of the server SA.

1. Acquisition of image information of printing time specification job, and printing time specification job information: The MFP1 associates and temporarily stores the image information of the printing time specification job received from the document reading unit or another MFP, the printing time specification job information (the specified printing time, the number of sheets with an image to be formed thereon, sheet type and sheet size) set on the MFP1 operation panel or the like, and the receiver code number (e.g., the code number of MFP5, which will be hereinafter referred to as "mfp5") as receiver information (Step S401).

2. Transmission of the image information of the printing time specification job and the printing time specification job information to the server: The MFP1 sends the image information of printing time specification job, printing time specification job information and receiver code number mfp5 to the server SA through a communications unit (not illustrated) (Step S402).

3. Reception of the image information of printing time specification job and the printing time specification job information: The server SA receives the image information of printing time specification job, printing time specification job information and receiver code number mfp5 (Step S501) from a desired MFP (e.g., MFP1) through a communications unit (not illustrated).

4. waiting for sheet acquisition startup time: The server SA monitors the internal clock. If the time matches the sheet acquisition startup time (Yes), the system goes to Step S503 to acquire sheets and waits for matching of time (No) (Step S502).

The sheet acquisition startup time is determined in the same manner as described with reference to the aforementioned Step S153.

3. Sheet presence/absence verification instruction for receiver MFP: If the sheet acquisition startup time matches, the server SA specifies the receiver code number MFP5, and transmits the image information of printing time specification job and printing time specification job information (Step S503).

4. Sheet presence/absence verification: Since the receiver code number mfp5 is specified by the MFP5, the MFP5 receives the image information of printing time specification job and the printing time specification job information, and makes sure that the sheets of matching sheet type and sheet size are stored in the sheet feed cassette, and that the number of remaining sheets stored is equal to or greater than the number of sheets with an image to be formed thereon (Step S601).

5. Sheet replenishment warning: If it has been found out in Step S601 that such sheets are not stored or the number of such sheets is insufficient (No), a warning is displayed on the MFP5 operation panel to prompt representing of sheets matching the sheet type and size of the printing time specification job (Step S602).

6. Transmission of sheet presence information to the server SA: If the sheets are stored, information is sent to the server SA to notify that the sheets are present (Step S603).

7. Reception of sheet presence information from the receiver MFP: The server SA waits to receive information from the MFP5 notifying the presence of sheets (Step S504).

8. Waiting for specified printing time: The server SA monitors the internal clock and wait for the time matching the specified printing time (No in Step S505).

9. Printing instruction to receiver MFP: If matching occurs (Yes), the server SA allows the MFP5 to execute the image forming instruction of the printing time specification job (Step S506).

10. Execution of image formation: Upon receipt of the image formation instruction information from the server SA, the MFP5 forms an image according to the image information of the printing time specification job received in Step S601 and the printing time specification job information (Step S604).

The aforementioned procedure ensures that a desired MFP allows any other MFP through the server to execute the printing time specification job with the sheets replenished correctly before the specified time. This eliminates the need of storing the image information of the printing time specification job and the printing time specification job information in each MFP at all times, whereby the memory size of the each MFP storage unit can be reduced.

It is also possible to install an MFP wherein the recipient sends the printing time specification job to the server through the MFP connected to the Internet.

In this case, the printing time specification job information and the receiver code number as receiver information set on the operation panel of the MFP1 (by the recipient) or receiver code number (e.g., MFP5 code number) (specified by the recipient) received (by the recipient) through the Internet or the like can be associated with each other and can be stored temporarily in Step S401.

Figure 10:
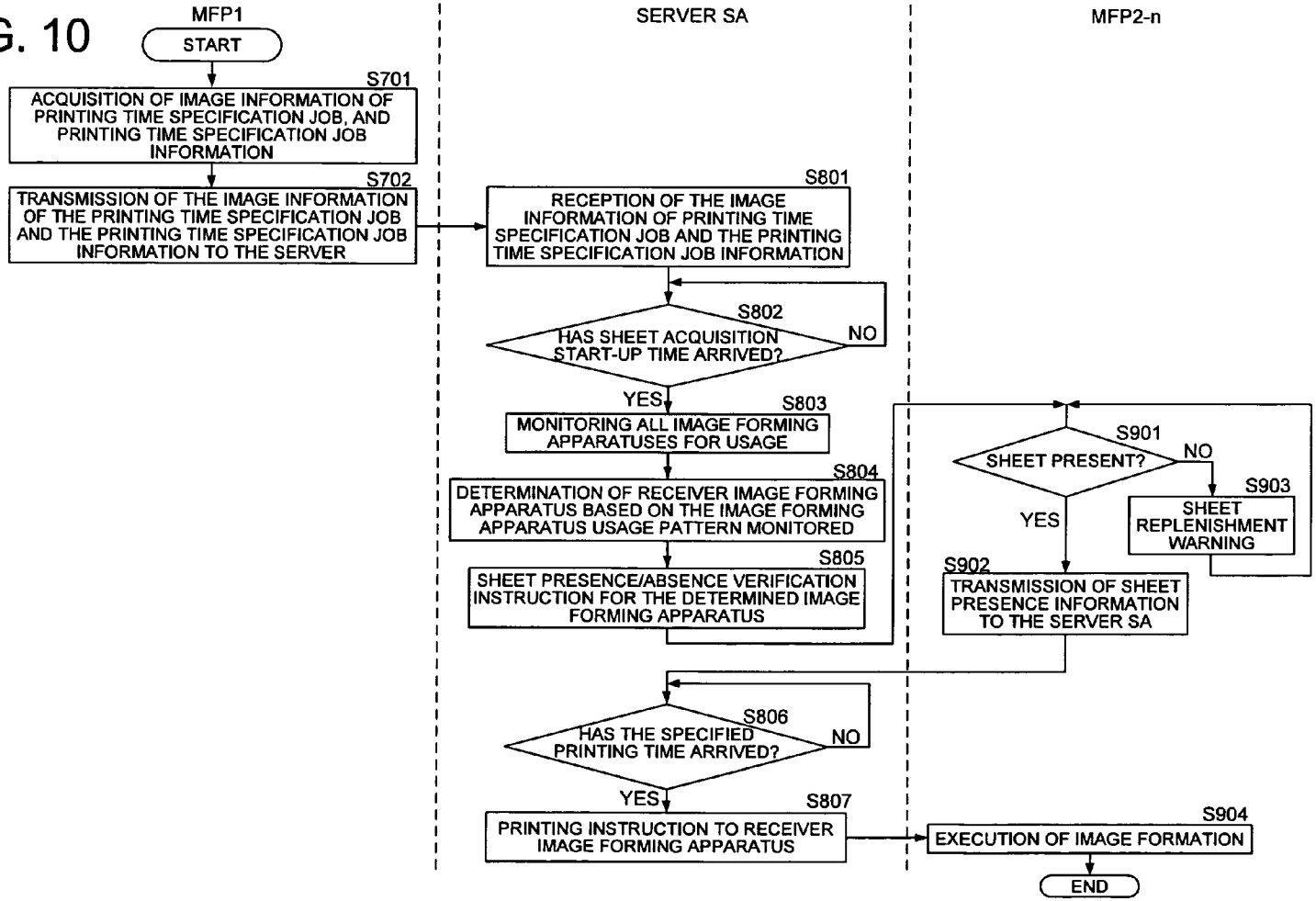
FIG. 10 is a third flow chart showing the exchange of information on the printing time specification job.

FIG. 10 is a third flow chart showing the exchange of information on the printing time specification job.

Referring to FIGS. 8 and 10, the following describes the case wherein, without a receiver MFP being specified by a desired MFP (transmitter MFP), the server SA determines the receiver MFP in response to the state of using each MFP (e.g., depending on how busy the printing time specification job is, namely, how busy the specified printing time of the printing time specification job is), so that image formation of the printing time specification job is executed.

1. Acquisition of image information of printing time specification job and printing time specification job information: The transmitter MFP (the transmitter MFP determined in Step S701 will be referred to as "MFP1" in the following description of the flow) the image information received by the document reading unit (not illustrated) or another MFP and the printing time specification job information set on the MFP1 operation panel (the specified printing time, the number of sheets with an image to be formed thereon, sheet type, and sheet size) are associated with each other and are stored temporarily (Step S701).

2. Transmission of image information of printing time specification job and printing time specification job information to server: The MFP1 uses a communications unit (not illustrated) to send the image information of printing time specification job and printing time specification job information to the server SA (Step S702).

3. Reception of image information of printing time specification job and printing time specification job information: The server SA monitors all the MFPs connected to the Internet (or placed under group management), and receives and stores the image information of printing time specification job and printing time specification job information sent from the MFP1 (Step S801).

If image information of printing time specification job are printing time specification job information have been sent from a plurality of MFPs, they are received and stored.

4. Wanting for sheet acquisition startup time: This procedure is the same as that of Step S502, and will not be described to avoid duplication (Step S802).

5. Monitoring all MFPs for usage: If there is a match with the sheet acquisition startup time, the server SA reads out all the printing time specification job information stored in Step S801. The specified printing time of the printing time specification job information of the MFP1, and those of other MFPs (other than MFP1) are monitored (Step S803).

6. Determination of receiver MFP based on the MFP usage pattern monitored: A desired MFP (e.g., MFP1) having the specified printing time different from the specified printing time of the printing time specification job information is determined by the server SA as the printing time specification job output MFP (e.g., MFP5; the printing time specification job output MFP determined in Step S804 in the following flow will be referred to as "MFP5") (Step S804).

7. Sheet presence/absence verification instruction for the determined MFP: The server SA sends the image information of printing time specification job and printing time specification job information to the MFP5 (Step S805).

8. Sheet presence/absence verification: The MFP5 receives the image information of printing time specification job and printing time specification job information, and makes sure that the sheets of the matching type and size are stored in the sheet feed cassette and the number of remaining sheets is equal to or greater than the number of sheets with an image to be formed thereon (Step S901).

9. Transmission of sheet presence information to server: When it has been determined in Step S901 that such sheets are stored (Yes), the MFP5 sends the information to the sever SA to notify that such sheets are present (Step S902).

10. Sheet replenishment warning: If there is no such storage of sheets in the MFP5 (No), a warning is displayed on the MFP5 operation panel to prompt replenishment of sheets of the type and size according to the printing time specification job. The system jumps to Step S901 to wait for sheet replenishment (Step S903).

11. Waiting for specified printing time: The server SA monitors the internal clock and waits until the time matches the specified printing time (No in Step S806).

12. Printing instruction to determined MFP: If there is a match (Yes), server SA sends the image formation instruction of printing time specification job to the MFP5 (Step S807).

13. Execution of image formation: Upon receipt of the image formation instruction information from the server SA, the MFP5 executes image formation according to the image information of printing time specification job and printing time specification job information received in Step S901 (Step S904).

As a result of the aforementioned procedure, the server can ensure that, of a plurality of image forming apparatuses under the management of the server, the image forming apparatus automatically specified in response to the usage patter of each image forming apparatus (e.g., specified printing time) executes printing time specification job, with the sheets correctly replenished before the specified time.

This eliminates the need of causing one MFP to execute a plurality of printing time specification job simultaneously. Thus, printing time specification job can be correctly performed before the specified printing time.

Further, before printing is disabled by the matching of printing time, the usage of each image forming apparatus must be checked in advance, and the image forming apparatus for image formation must be selected and specified.

Figure 11:
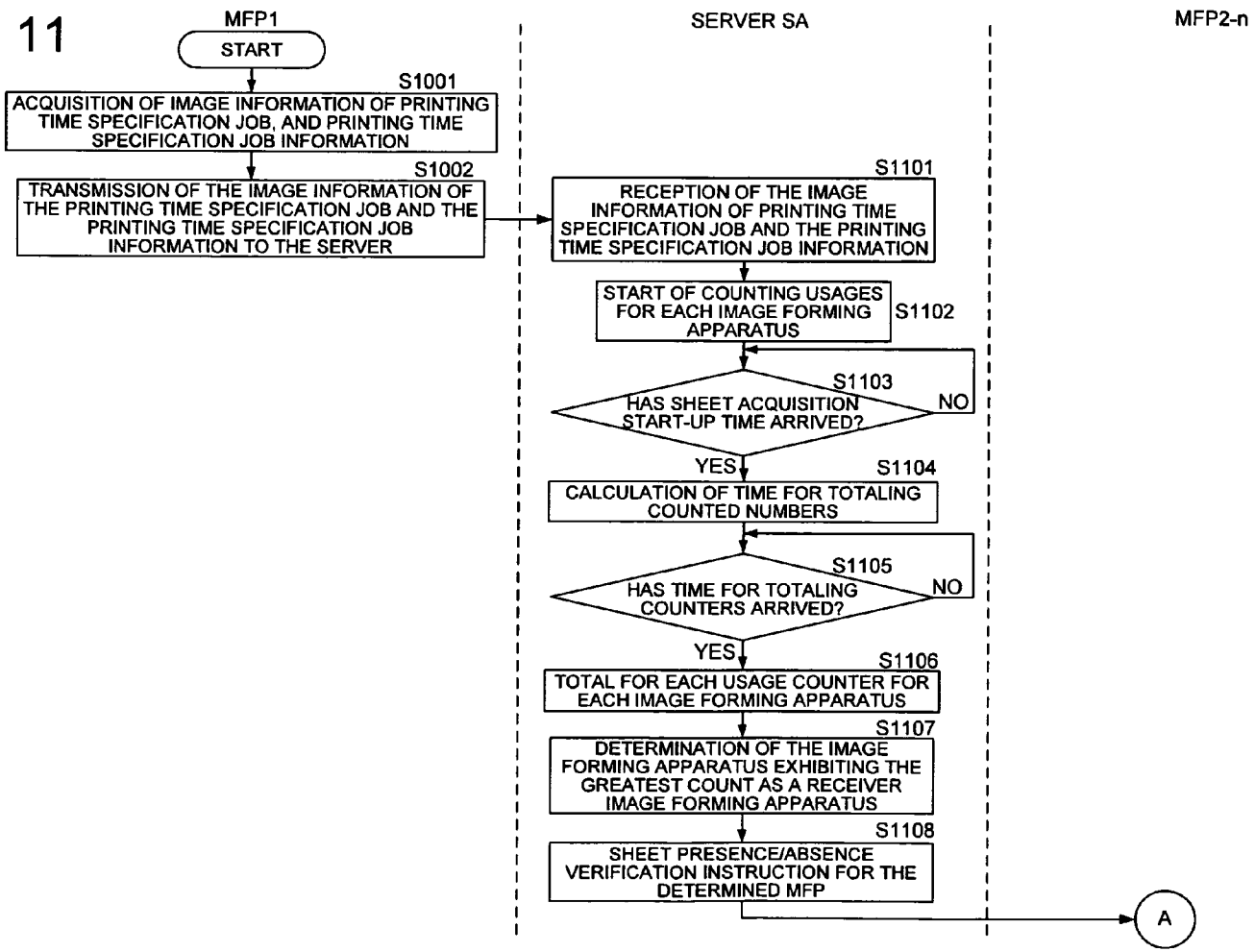
FIG. 11 is a fourth flow chart showing the exchange of information on the printing time specification job.
Figure 12:
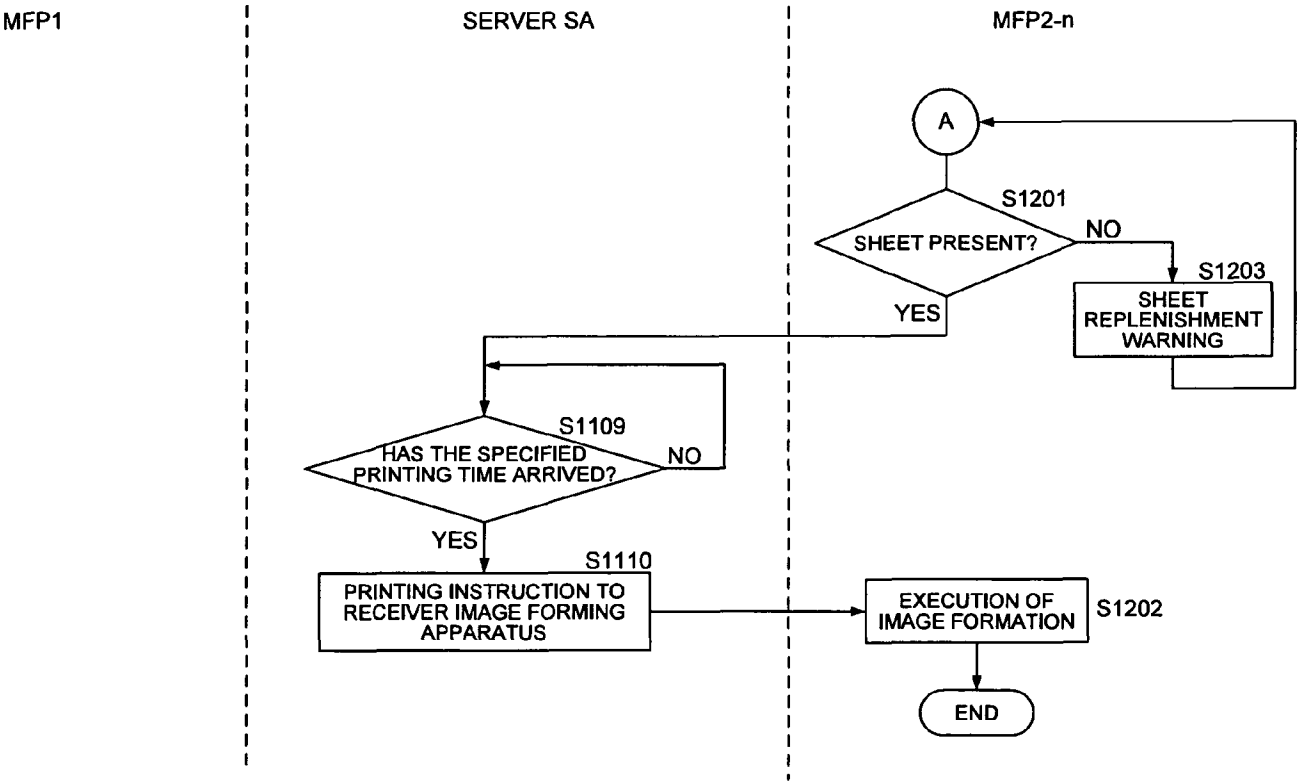
FIG. 12 is a fourth flow chart showing the exchange of information on the printing time specification job.

FIG. 11 and FIG. 12 are the fourth flow charts showing the exchange of information on the printing time specification job.

FIG. 12 shows the continuation of the flow of FIG. 11.

Referring to FIGS. 2, 8, 11 and 12, the following describes the case wherein the MFP most frequently employed by the user is selected by the server SA as the machine for outputting the printing time specification job, from the time of setting the printing time specification job of each MFP to the sheet acquisition startup time.

1. Acquisition of image information of printing time specification job and printing time specification job information: The procedure is the same as that in Step S701, and will not be described to avoid duplication (Step S1001).

2. Transmission of image information of printing time specification job and printing time specification job information to server: The procedure is the same as that in Step S702, and will not be described to avoid duplication (Step S1002).

3. Reception of image information of printing time specification job and printing time specification job information to server: The procedure is the same as that in Step S801, and will not be described to avoid duplication (Step S1101).

4. Start of counting usages for each MFP: The server SA has a plurality of usage counters for counting usages (the number of printing operation for job) of each MFP linked to the Internet or the like. Upon receipt of the image information of printing time specification job and printing time specification job information, it starts counting usages for each MFP (Step S1102).

For example, when ten MFPs are connected, ten usage counters corresponding to MFPs are provided. When an MFP has completed printing of one job, the usage counter of this MFP increments one.

5. Waiting for sheet acquisition startup time: The procedure is the same as that in Step S802, and will not be described to avoid duplication (Step S1103).

6. Calculation of time for totaling counted numbers: According to the printing time specification job information (the specified printing time, the number of sheets with an image to be formed thereon, sheet type, and sheet size) stored in the Step S1101, the server SA refers to the specified printing time and calculates the time for totaling counted numbers (Step S1104).

Assume that the usage interval time of the MFP used most frequently in the normal case is t1, the allowance of time is tα, the specified printing time is T, and the time for totaling counter is Tc. The time for totaling the counter is calculated according to the following formula:

$$Tc=T-t1-t\alpha$$

7. Arrival of the time for totaling counters: The server SA monitors an internal clock and waits for the arrival of the time for totaling counters, Tc (Step S1105).

8. Total for each usage counter for each MFP: Upon arrival of the time for totaling counters Tc (Yes), the server SA terminates counting of each usage counter started in Step S1102, and finds a total of the counts of all usage counters (Step S1106).

9. Determination of the MFP exhibiting the greatest count as a receiver MFP: The MFP whose count is the greatest as a result of adding up the counts for each MFP is determined as a receiver MFP (e.g., KMP6: the MFP exhibiting the greatest count will be referred to as "MFP6" in the following description of flow) (Step S1107).

10. Sheet presence/absence verification instruction for the determined MFP: The server SA sends the image information of printing time specification job, printing time specification job information and sheet presence/absence verification instruction information to the KMP6 determined in Step S1107 (Step S1108).

11. Sheet presence/absence verification: Upon receipt of the sheet presence/absence verification instruction, the MFP6 receives the image information of printing time specification job and printing time specification job information, and makes sure that the sheets of the matching type and size are stored in the sheet feed cassette, and that the number of remaining sheets stored is equal to or greater than the number of sheets with an image to be formed thereon (Step S1201).

12. Sheet replenishment warning: If the aforementioned sheets are not stored when checked in Step S1201 (No), the MFP6 ensures that a warning is displayed on the MFP6 operation panel to prompt replenishment of the sheets having the matching sheet type and size for the printing time specification job. Then the system jumps to Step S1201 to wait for the replenishment of these sheets.

13. Waiting for specified printing time: The procedure is the same as that in Step S806, and will not be described to avoid duplication (Step S1109).

14. Printing instruction for the determined MFP: Upon receipt of arrival of the specified printing time (Yes), the server SA sends the image formation instruction information of printing time specification job to the MFP6 (Step S1110).

15. Execution of image formation: Upon receipt of image formation instruction information, MFP6 executes image formation according to the image information of printing time specification job printing time specification job information received in Step S1201 (Step S1202).

As a result of the aforementioned procedure, the server can ensure that printing time specification job is automatically executed by the most frequently used image forming apparatus out of a plurality of image forming apparatuses placed under the management of the server, while the sheets have been correctly replenished before the specified time.

To ensure that printing time specification job is executed by the frequently used image forming apparatus, the image forming apparatus used to execute the printing time specification job is more frequently operated, with the result that there is smaller probability of sheet replenishment being delayed.

This arrangement minimizes the possibility of printing time specification job being disabled by shortage of sheets.

Further, the arrangement also eliminates the need of checking the frequency of use of each image forming apparatus in advance and selecting and specifying the image forming apparatus used for image formation to ensure timely sheet replenishment.

Figure 13:
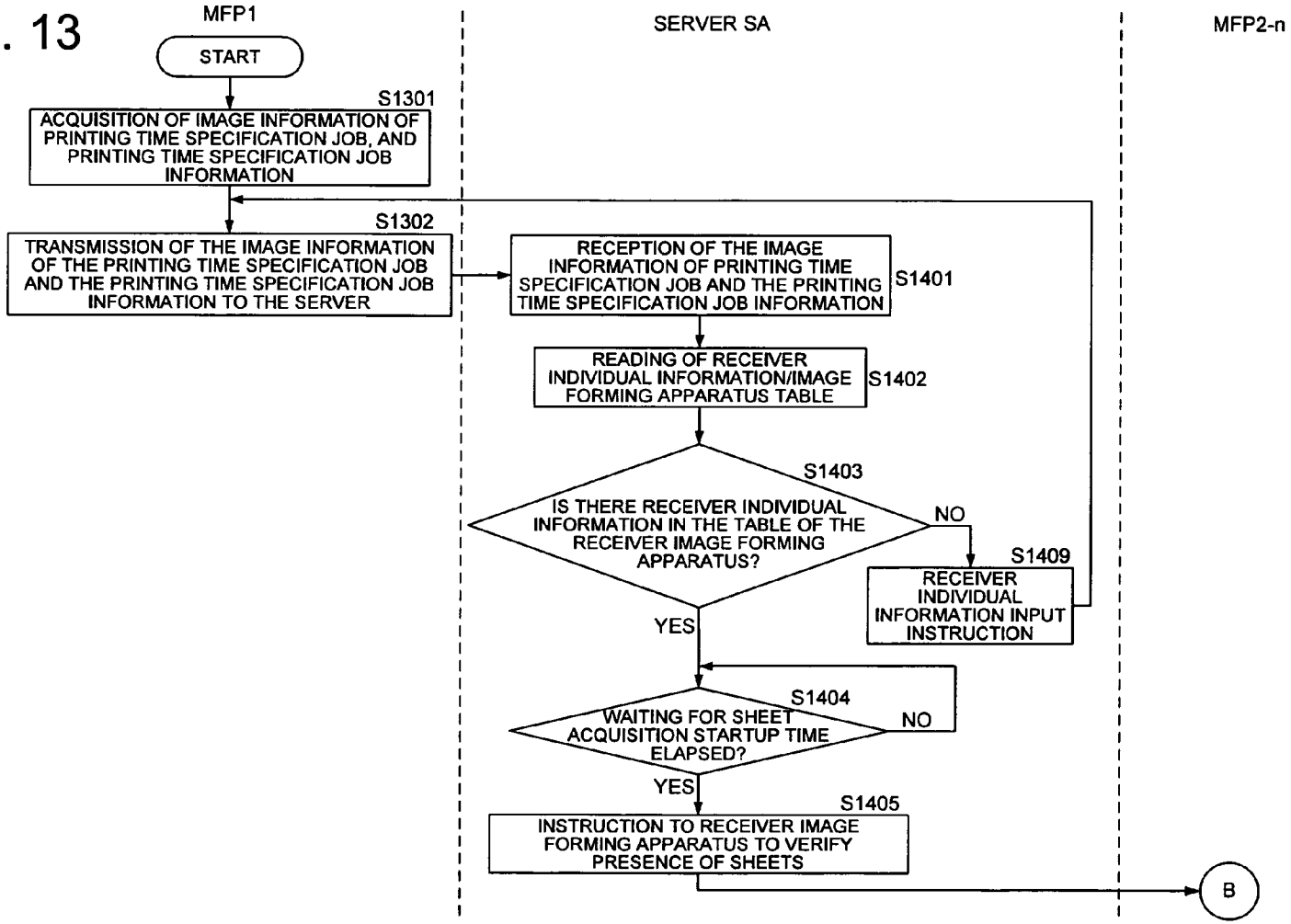
FIG. 13 is a fifth flow chart showing the exchange of information on printing time specification job.
Figure 14:
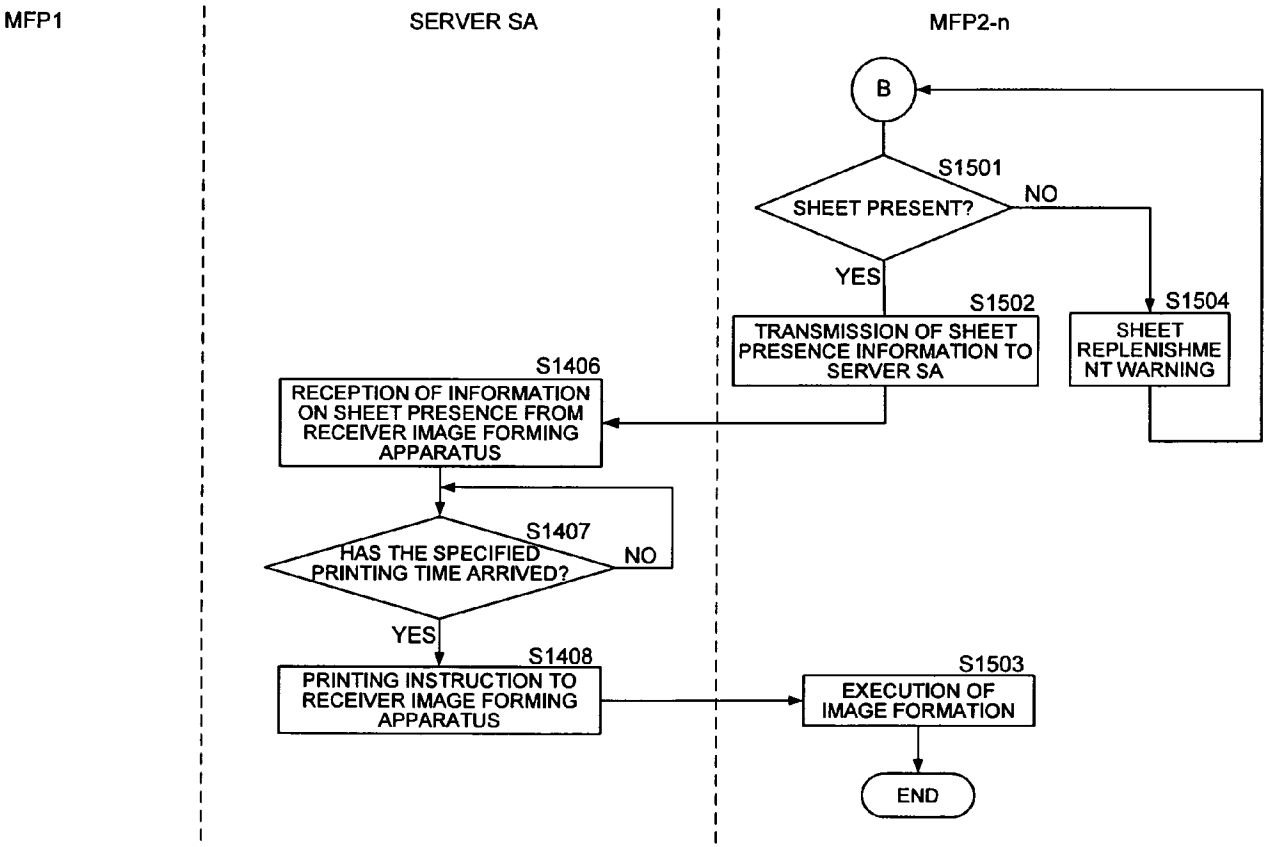
FIG. 14 is a fifth flow chart showing the exchange of information on printing time specification job.

FIG. 13 and FIG. 14 are fifth flow charts showing the exchange of information on printing time specification job.

It should be noted that FIG. 14 is a continuation of the flow of FIG. 13.

FIG. 15 is an explanatory diagram representing the receiver individual information/image forming apparatus table.

The receiver individual information/image forming apparatus table A of FIG. 15 is stored in the server. It incorporates an image forming apparatus column A1 for recording each image apparatus name, and a receiver individual information column A2 for storing the receiver individual information (receiver individual information) received by each image forming apparatus.

Referring to FIGS. 2, 8, 13, 14 and 15, the following describes the cases wherein, when the user name to be sent by a desired MFP (transmitter MFP) has been specified, the server SA searches the past history to find out the MFP to which the specified user name belongs, and determines the receiver MFP, whereby the image formation of the printing time specification job is executed.

1. Acquisition of image information of printing time specification job and printing time specification job information: The receiver MFP (e.g., MFP1; the receiver MFP determined in Step S1301 will be referred to as "MFP1" in the following description of the flow) ensures that the image information received from the document reading unit (not illustrated) or another MFP and the printing time specification job information (the specified printing time, the number of sheets with an image to be formed thereon, sheet type, receiver individual information <e.g., 1234> and sheet size) set on the MFP1 operation panel or the like are associated with each other and are stored temporarily (Step S1301).

2. Transmission of image information of printing time specification job and printing time specification job information to the server: The MFP1 uses the communications unit (not illustrated) to send the image information of printing time specification job and printing time specification job information to the server SA (Step S1302).

3. Reception of image information of printing time specification job and printing time specification job information: The server SA uses a communications unit (not illustrated) to receive from the MFP1 the image information of printing time specification job and printing time specification job information (the specified printing time, the number of sheets with an image to be formed thereon, sheet type, sheet size and receiver individual information <e.g., 1234>) (Step S1401).

4. Reading of receiver individual information/image forming apparatus table: For all the MFPs from the storage unit, the server SA reads the receiver individual information/image forming apparatus table A of FIG. 15 that stores the information on the individual having printed using each MFP (Step S1402).

5. Receiver individual information presence/absence verification for receiver information column A1 of the receiver individual information/image forming apparatus table A: The server SA checks if the receiver individual information/image forming apparatus table A having been read contains the receiver individual information <e.g., 1234: *a*1> having been received in Step S1401 or not (Step S1403).

6. Waiting for sheet acquisition startup time: This procedure is the same as that of Step S502, and will not be described to avoid duplication (Step S1404).

7. Sheet presence/absence verification instruction for receiver: When receiver information column A1 contains receiver individual information <e.g., 1234: *a*1> (Yes), the server SA determines the MFP including the receiver individual information as the MFP to which the printing time specification job is to be outputted (e.g., MFP2; the MFP to which the printing time specification job determined in Step S1405 is to be outputted will be referred to as "MFP2" in the following description of the flow).

When a plurality of MFPs contain receiver individual information, the MFP having a greater amount of receiver individual information is determined as the MFP to which the aforementioned job is to be outputted.

The image information of printing time specification job and printing time specification job information is sent to the determined MFP. At the same time, a sheet presence/absence verification instruction is given (Step S1405). It should be noted that the receiver individual information/image forming apparatus table A to be read in Step S1405 includes the addition of a combination of the receiver individual information and output MFPs made in Step S1408 (to be described later) in the past.

8. Sheet presence/absence verification: The MFP2 to which the image information of printing time specification job and printing time specification job information have been sent by the server SA receives such information and makes sure the sheets of matching sheet type and sheet size are stored in the sheet feed cassette, and that the number of remaining sheets is equal to or greater than the number of sheets with an image to be formed thereon (Step S1501).

9. Transmission of sheet presence information to server SA: If the matching sheets are stored in the sheet feed cassette in Step S1501 (Yes), the MFP2 sends the information on the presence of sheets to the server SA (Step S1502).

10. Sheet replenishment warning: If the matching sheets in Step S1501 are not stored in the sheet feed cassette (No), the MFP2 displays a warning on the operation panel (not illustrated) or the like to prompt replenishment of sheets. Then the MFP2 jumps to the Step S1501, and waits for sheet replenishment (Step S1504).

11. Reception of information on sheet presence from receiver MFP: Upon receipt of the information on the presence of sheets from the MFP2, the server SA proceeds to Step S1407 (Step S1406).

12. Waiting for specified printing time: The server SA monitors the internal clock and waits until the time matches the specified printing time (No). If matching has been found (Yes), the system proceeds to Step S1408 (Step S1407).

13. Receiver MFP printing instruction: The server SA sends the image formation instruction information of the printing time specification job to the MFP2 (Step S1408).

In this case, the server SA reads out the receiver individual information/output image forming apparatus table (FIG. 15), and adds a combination of new receiver individual information (e.g., 1234 *a*2) and output MFP (e.g., MFP2).

14. Execution of image formation: The MFP having received the image formation instruction information feeds sheets according to the printing time specification job information and executes image formation according to the image information of printing time specification job having received in Step S1501 (Step S1503).

It is possible to cut off the transfer time when image formation instruction is given in Step S1503 by receiving the image information of printing time specification job and printing time specification job information in Step S1501, before the printing instruction is given in Step S1503.

15. Receiver MFP input instruction: If there is no receiver individual information <e.g., 1234> in the Step S1403 (No), the server SA gives a receiver MFP input instruction to the receiver MFP (e.g., MFP1) in order to prompt inputting of the receiver individual information (Step S1409).

In this case, the operator inputs receiver individual information in Step S1301, and the flow resumes in Step S1301.

The receiver individual information/image forming apparatus table A can be overwritten so that only the combination of the receiver individual information whose individual last executed the printing time specification job, and MFP will remain. In this case, printing instruction is given to the MFP last used by the receiver user, and therefore, printing of printing time specification job is carried out by the MFP last used by the user.

Further, in the method described with reference to FIGS. 3, 5, 7, 9, 10, 11, 12, 13, and 14, the printing time specification job information and the digital image data of printing time specification job can be deleted and corrected until arrival of the specified printing time. This can be done, for example, by displaying the printing time specification job condition setting screen 90, and selecting and re-setting the release keys 9012, 9022, 9032 and 9042.

Thus, when an image of printing time specification job is to be sent to a specific individual, the server can ensure that the image forming apparatus wherein the individual wishing to send is normally present executes printing time specification job automatically with sheets correctly replenished before specified time, merely by setting the individual information to be sent, without specifying the receiver image forming apparatus.

The aforementioned description refers to the structure and method wherein a desired MFP allows another desired MFP to execute printing of the image of printing time specification job through the server. It is also possible to make such arrangements that a desired MFP causes another desired MFP to print the image of printing time specification job by each MFP or specific MFP playing the role of a server

What is claimed is:

1. An image forming apparatus enabling an operator to specify a time to start image formation, comprising:

an image forming condition setting unit for setting an image forming condition including the time to start image formation specified by an operator and an information related to recording material;

a control unit adapted to calculate a recording material acquisition startup time for starting to acquire a recording material by subtracting a sheet acquisition enabled time from the specified printing time based on the image forming condition set by the image forming condition setting unit, wherein the sheet acquisition enabled time is set in advance as a time period enabling an operator to replenish the recording material, monitor a clock to determine when the calculated recording material acquisition startup time arrives, verify presence of the recording material specified by the image forming condition based at least partly on information from a sheet detecting unit, when the clock indicates that the calculated recording material acquisition startup time has arrived, and issue a warning related to a replenishment of the recording material, and/or to inhibit formation of image, in the case, as a result of the verification of the presence of the recording material, where there is no recording material specified under the image forming condition or in the case where the recording material is insufficient.

2. The image forming apparatus of claim 1 wherein the control unit calculates a recording material acquisition startup time based on the information related to the specified printing time set by the image forming condition setting unit and on a prestored recording material acquisition time.

3. The image forming apparatus of claim 1, wherein the control unit inhibits other printing job from using the recording material specified by the image forming condition after the recording material acquisition startup time.

4. The image forming apparatus of claim 1, wherein the control unit sends a message to a specified address to prompt replenishment of the recording material in the case where there is no recording material specified under the image forming condition or in the case where the recording material specified under the image forming condition is insufficient, after the recording material acquisition startup time.

5. The image forming apparatus of claim 1, wherein the information related to the recording material among the aforementioned image forming condition contains at least one of type information and size information.

6. The image forming apparatus of claim 1, comprising a deletion/modification section for deleting and/or modifying the image forming condition.

7. The image forming apparatus of claim 1, further comprising a plurality of stacking sections for stacking the recording material having completed image forming thereon, wherein the control unit stacks the recording material having completed image forming thereon related to a printing time specification job as a job for specifying the printing startup time, in a specified stacking section out of the plurality of stacking sections.

8. An image forming apparatus communicably connecting to an other image forming apparatus, sending to the other image forming apparatus a printing time specification job enabling an operator to specify a time to start image formation and making the other image forming apparatus execute the printing time specification job, comprising:

an image forming condition setting unit for setting an image forming condition including the time to start image formation specified by an operator and an information related to a recording material;

a control unit adapted to calculate a recording material acquisition startup time for starting to acquire the recording material by subtracting a sheet acquisition enabled time from the specified printing time based on the image forming condition set by the image forming condition setting unit, wherein the sheet acquisition enabled time is set in advance as a time period enabling an operator to replenish the recording material, monitor a clock to determine when the calculated recording material acquisition startup time arrives, check the presence of the recording material specified by the image forming condition at the other image forming apparatus based at least partly on information from a sheet detecting unit, when the clock indicates that the calculated recording material acquisition startup time has arrived, and inhibit the other image forming apparatus from forming the image, in the case where, as a result of the check of the presence of the recording material, there is no recording material specified under the image forming condition or in the case where the recording material is insufficient.

9. The image forming apparatus of claim 8, wherein the control unit calculates the recording material acquisition startup time based on the information related to the specified printing time set by the image forming condition setting unit and based on a prestored time for acquiring printing material.

10. The image forming apparatus of claim 8, wherein the information related to the recording material among the image forming condition contains at least one of type information and size information.

11. The image forming apparatus of claim 8, comprising a deletion/modification section for deleting and/or modifying the image forming condition.

12. A printing control method in an image forming system, wherein the system comprises a plurality of image forming apparatuses communicably connected each other and a first image forming apparatus of the plurality of image forming apparatuses sends a printing time specification job to a second image forming apparatus of the plurality of image forming apparatuses to execute the printing time specification job, the control method comprising:

acquiring a printing time specification job information including the time to start image formation specified by an operator and an information related to recording material, calculating a recording material acquisition startup time for starting to acquire a recording material by subtracting a sheet acquisition enabled time from the specified printing time based on the printing time specification job information, wherein the sheet acquisition enabled time is set in advance as a time period enabling an operator to replenish the recording material, monitoring a clock to determine when the calculated recording material acquisition startup time arrives, checking the presence of recording material specified by the printing time specification job information to the second image forming apparatus based at least partly on information from a sheet detecting unit, when the calculated recording material acquisition startup time arrives, and inhibiting executing the printing time specification job after the recording material acquisition startup time in the case where the checking of the recorded material shows that there is no recording material specified under the printing time specification job information or in the case where the recording material is insufficient.

13. The printing control method of claim 12, wherein in the step of calculating the recording material acquisition startup time, the acquisition startup time is calculated based on information related to a specified printing time and based on a prestored time for acquiring recording material.

14. The printing control method of claim 12, further comprising making the second image forming apparatus issue a warning related to a replenishment of the image recording material in the case where there is no recording material specified under the printing time specification job information or in the case where the recording material specified under the printing time specification job information is insufficient.

15. The printing control method of claim 12, wherein the system includes a server communicably connected to the first image forming apparatus and to the second image forming apparatus and the server executes each step of the image control method of claim 12.

* * * * *